United States Patent [19]

Fast

[11] Patent Number: 4,531,313

[45] Date of Patent: Jul. 30, 1985

[54] MERCHANDISE INFORMATION TAG WITH IMPROVED MOUNTING ARRANGEMENT

[76] Inventor: Jacob Fast, 7561 NW. 9th St., Plantation, Fla. 33317

[21] Appl. No.: 473,650

[22] Filed: Mar. 9, 1983

Related U.S. Application Data

[63] Continuation-in-part of Ser. No. 422,010, Sep. 23, 1982, , which is a continuation-in-part of Ser. No. 358,925, Mar. 17, 1982.

[51] Int. Cl.[3] ..... G09F 3/18

[52] U.S. Cl. ..... 40/19.5; 40/2 R; 40/20 R

[58] Field of Search ..... 40/20, 10 R, 19.5, 2, 40/584

[56] References Cited

U.S. PATENT DOCUMENTS 1,005,894 10/1911 Senseman ..... 40/20 R
2,564,293 8/1951 Ammon ..... 40/20 R

FOREIGN PATENT DOCUMENTS 884536 12/1961 United Kingdom ..... 40/20 R

*Primary Examiner*—Gene Mancene
*Assistant Examiner*—Wenceslao J. Contreras
*Attorney, Agent, or Firm*—Holman & Stern

[57] ABSTRACT

A product identification tag is fabricated from plastic and, in one embodiment, snap-fits onto a support member for a peg board hook without requiring removal of the hook from the peg board or the displayed merchandise from the hook. Support structure on the tag includes two holes spaced to correspond to the spacing between two legs in the hooked support member which are insertable into two peg board holes, respectively. Access channels are cut from a nearby mounting edge of the tag to the holes to permit the legs to be inserted into the respective holes only when portions of the tag which bound the access channels are flexed. In a second embodiment, using the same or a different form of tag mounting structure, the tag is secured adjacent a support wall, behind supported merchandise items, and projects forwardly alongside the supported merchandise items before terminating in a display section which is folded or bent to be disposed forwardly of the suspended merchandise.

6 Claims, 29 Drawing Figures

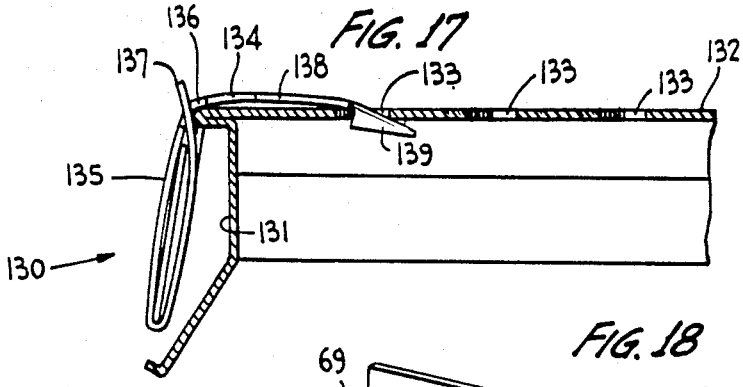
FIG. 17
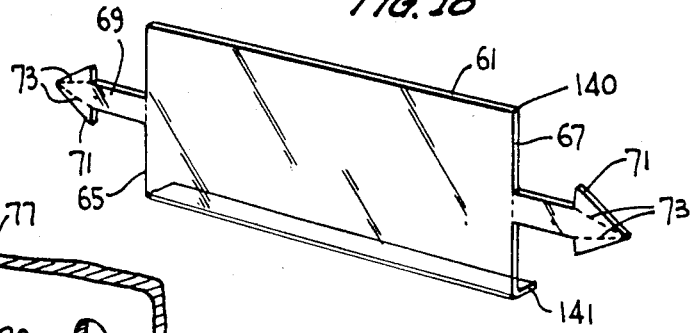
FIG. 18
FIG. 19
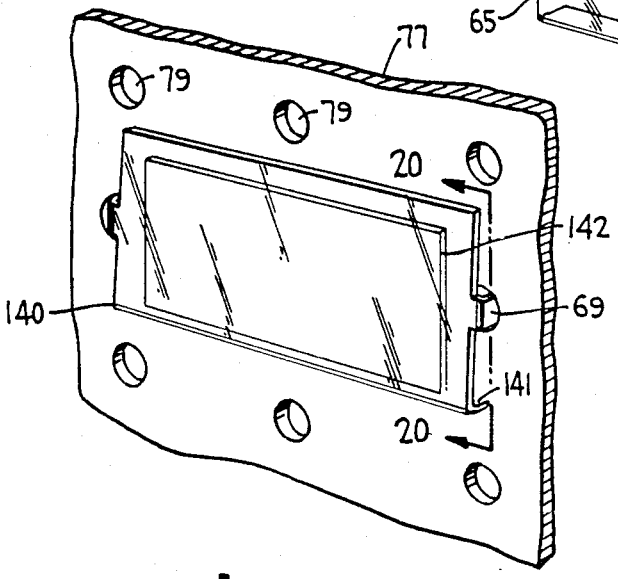
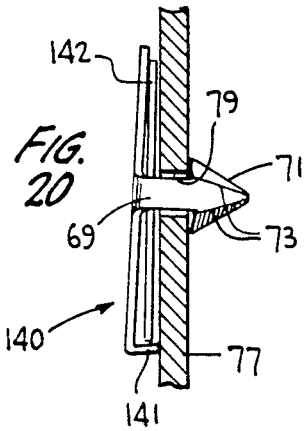
FIG. 20
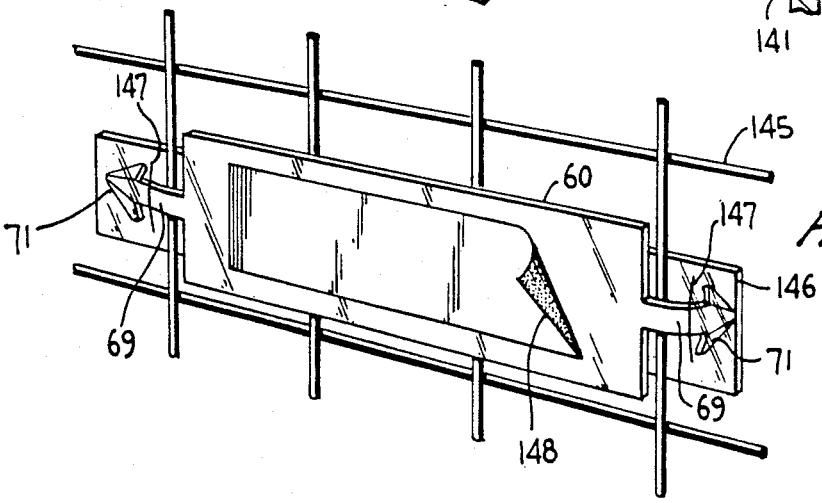
FIG. 21

FIG. 22
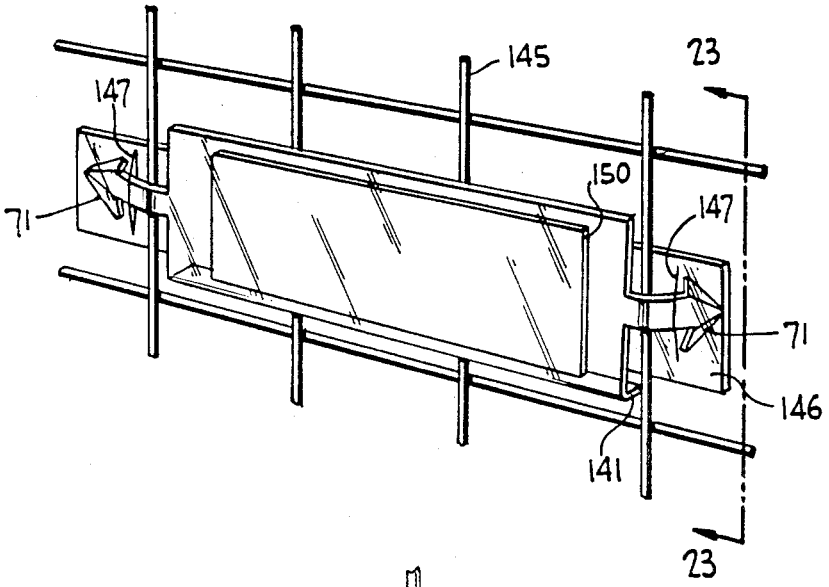
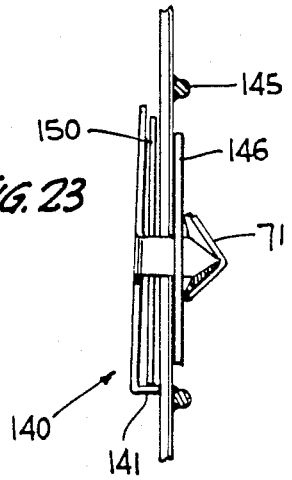
FIG. 23

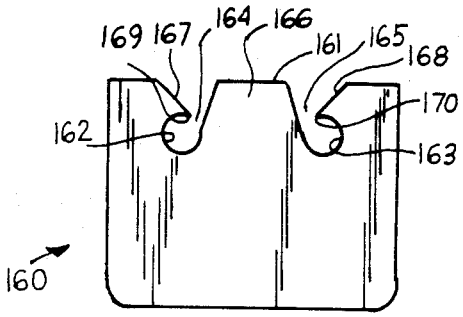
FIG. 24
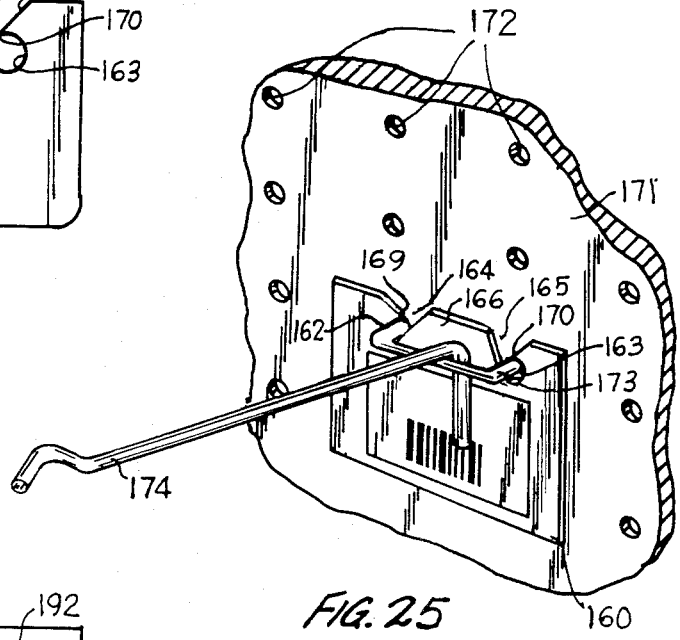
FIG. 25
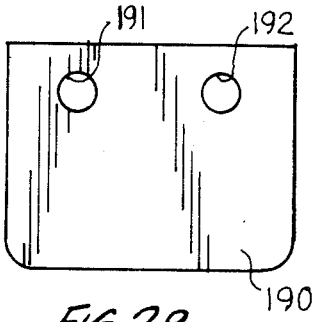
FIG. 28
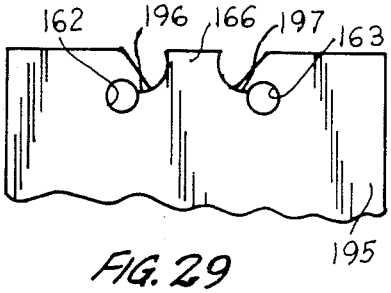
FIG. 29
FIG. 27
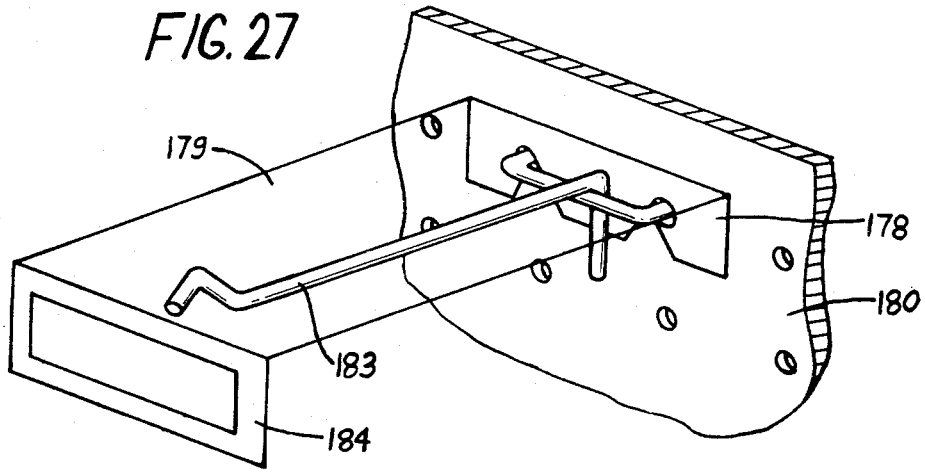

MERCHANDISE INFORMATION TAG WITH IMPROVED MOUNTING ARRANGEMENT

CROSS REFERENCE TO RELATED APPLICATION

This application is a continuation-in-part of my copending U.S. patent application Ser. No. 06/422,010, filed Sept. 23, 1982 and entitled "IMPROVED MERCHANDISE INFORMATION TAG" which is a continuation-in-part of my copending U.S. patent application Ser. No. 06/358,925, filed Mar. 17, 1982, and entitled "MERCHANDISE INFORMATION TAG".

TECHNICAL FIELD

The present invention relates to merchandise information tags which are associated with merchandise displays and generally bear price and/or product identification legends or codes. More specifically, the present invention relates to improvements in such tags.

BACKGROUND OF THE INVENTION

Point of sale merchandising displays very often involve the use of peg hooks, which project outwardly from peg boards or other vertically-oriented apertured walls, or J-hooks, which secure to the price molding formed at the exposed edge of a merchandising shelf. Blister packs are generally suspended from these hooks in the manner in which they can be readily displayed in an attractive manner for passers-by. Many such displays employ product information tags or cards which include price or information legends or codes and serve to indicate when a product is out of stock. Specifically, one prior art product information card is described and illustrated in U.S. Pat. No. 4,245,414 (Shypula), wherein the "out-of-stock" card is suspended from a peg hook behind the displayed merchandise so that its product description is visible after all of the merchandise has been removed from the hook. In this manner, the proprietor is made aware of the need to purchase replacement items. It should be noted, however, that since the card is not visible until the product is depleted or out of stock, the proprietor is often faced with not having the product in stock during the time between re-order and delivery. In addition, product information cards or tags of this type require that the peg hook be dis-assembled and removed from the peg board in order for the card or tag to be attached or removed from the hook. This can be quite time consuming, particularly when a large number of cards or tags are to be mounted and/or when the cards or tags are to be attached or replaced on hooks from which merchandise is suspended.

Other types of product information tags are adhesively-backed paper tags which, upon the removal of a temporary backing, are affixed directly to a price molding or other support surface. Such tags, however, tend to curl and tear and are not re-usable.

Generally, the cards and tags of the type described above tend to be eye-sores because of their bright colors. In addition, the aforementioned cards and tags, once affixed to the support hook or support surface, will limit the flexibility of the merchandise display because the tags cannot be readily moved so as to permit relocation of existing merchandise on the display or changes in the type of displayed merchandise.

It is sometimes desirable that merchandise information be displayed forwardly of the merchandise which is suspended from a peg hook. With prior art merchandise information cards, this is only possible with a card or tag that is itself supported from the peg hook and which must be removed to permit a merchandise item to be removed from the hook. This is obviously undesirable since it requires the consumer to remove the information card, then remove a merchandise item, and then replace the information card. This is time consuming for the consumer, who often only has one hand free, and often results in the identification card placed on the wrong hook or not replaced at all.

SUMMARY OF THE INVENTION

It is therefore an object of the present invention to provide a product information tag which is supported in a manner so as to be visible prior to depletion of stock and yet is sufficiently unobtrusive so as not to present an eye-sore.

It is another object of the present invention to provide a product information tag which is re-usable for a variety of different products and which is mounted in such a way as to permit relocation of the displayed merchandise, along with the tag, without destroying the tag or in any way limiting the position of the merchandise.

It is another object of the present invention to provide a product information tag which is durable, maintains its substantially planar configuration and which can be oriented in a variety of different positions so as to permit increased merchandise display flexibility.

It is still another object of the present invention to provide a product information tag which can be mass-produced simply and inexpensively and yet which has all of the advantages set forth in the preceding objects of the present invention.

A further object of the present invention is to provide a product information tag which can be secured to or removed from a peg hook without requiring dis-assembly of the peg or removal of the peg hook from the peg board and without requiring removal of merchandise items supported by the hook.

Yet another object of the present invention is to provide a product information tag for a peg board hook which displays product information forwardly of peg-supported merchandise items but which does not have to be removed from the peg in order to remove merchandise items from the peg.

In accordance with the present invention, an information tag for displayed merchandise takes the form of a plastic member or sheet which is sufficiently rigid so as to retain its shape when supported vertically along its lower edge. At least one surface, namely the display surface, of the tag may readily adhere to the adhesive backing of pressure-sensitive labels which can be placed one over the other as the tag is used with different products. Alternatively, the sheet may be folded over on itself to form a pocket into which a label may be inserted without adhering to the tag. As a further alternative, the sheet may be elongated to extend forwardly above the hook and its forward end folded down to be presented forwardly of the supported merchandise. The indicia-bearing portion of the tag is preferably rectangular and includes a tag-supporting structure extending outwardly from one of the edges of the rectangle and formed integrally therewith. In one embodiment, the tag-supporting structure includes a narrow neck portion which joins the rectangular indicia-bearing portion with a slotted distal supporting structure portion. The slot in the distal portion extends parallel to the edge of the indicia-bearing portion from which the support stem or neck extends. The slot has a predetermined length which is equal to or only slightly greater than the support prongs of a peg hook or the support member of a J-hook so that the tag can be suspended from its slot through which the support structure of the peg hook or J-hook is inserted. Since the peg hooks and J-hooks can be moved to different locations along a peg board or price molding, as the case may be, the tag is movable therewith so as not to preclude flexibility in the locations of the displayed merchandise. The tag can be displayed with its indicia-bearing portion projecting upward or downward from the slot, depending upon the nature of the displayed merchandise and whether or not the proprietor desires that the tag be visible prior to depletion of the stock. The tag has further flexibility in that the space between the slotted portion and the indicia-bearing portion, on either side of the stem or neck, may alternatively serve as a support structure for certain types of merchandise display hooks.

In another embodiment, the support structure includes anchor-like members projecting from one or more edges of the tag, which members take the form of a stem with wing-like members at its distal end. The anchor-like members are positioned to be inserted through holes in a peg board or shelf or specially provided backing member with the wing-like members serving as anchors against the rear surface of the board or other backing to prevent inadvertent removal of the tag. Instead of adhering the label to the tag, the bottom edge of the tag may be folded back toward the backing to provide a support shelf which supports the bottom edge of the label between the tag and the backing.

In a further embodiment of the invention the support structure for the tag snaps into a support member which secures a peg board hook to a peg board. The standard peg hook support member is generally U-shaped with its legs spaced to project into two holes in the peg board. The tag mounting structure has two similarly spaced holes, each being opened to a near edge of the tag through respective mounting access channels. These channels are more closely spaced than are the legs of the peg support member so that the tag must be flexed to pass the access channels over the support member legs and into the tag support holes. The resilient tag is then unflexed to move the access channels inward of the support member legs and to permit the tag to be suspended or supported by the support member legs in the support holes of the tag. Removal of the tag is similarly achieved by flexing the tag.

In both embodiments, the tags are preferably die-cut in multiple numbers in a sheet with adjacent edges of adjacent tags sharing common die-cut lines to thereby minimize the waste of material in the sheet.

BRIEF DESCRIPTION OF THE DRAWINGS

The above and still further objects, features, and advantages of the present invention will become apparent upon consideration of the following detailed description of specific embodiments thereof, especially when taken in conjunction with the accompanying drawings, wherein:

FIG. 17 is a view in section of the tag of FIG. 15 taken along lines 17—17;

FIG. 18 is a view in perspective of another modified version of the tag of FIG. 7;

FIG. 19 is a view in perspective of the tag of FIG. 18 shown secured to a peg board;

FIG. 20 is a view in section taken along lines 20—20 of FIG. 19;

FIG. 21 is a view in perspective of a further modified portion of the tag of FIG. 7 shown secured to a display basket by means of a special backing member;

FIG. 22 is a view in perspective of another tag of the present invention in which the features of the embodiments of FIGS. 7, 18 and 21 are combined;

FIG. 23 is a view in section taken along lines 23—23 of FIG. 22.

FIG. 24 is a view in plan of a further modified version of the tag of FIG. 1 having a mounting structure which permits the tag to be snap fit onto a peg board hook structure;

FIG. 25 is a view in perspective of the tag of FIG. 24 displayed on a peg board hook;

FIG. 27 is a view in perspective showing the tag of FIG. 26 displayed in conjunction with a peg board hook structure; and FIGS. 28 and 29 are views in plan of respective further modified versions of the tag of FIG. 1 having mounting structures adapted for use with a peg board hook.

DESCRIPTION OF THE PREFERRED EMBODIMENTS

Figure 1:
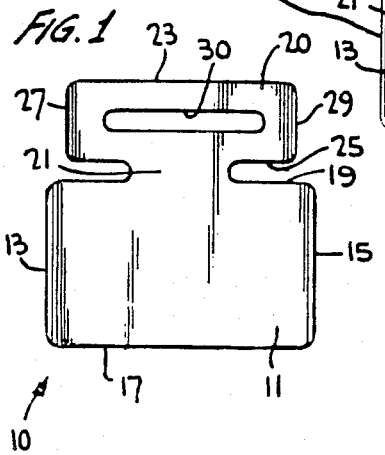
FIG. 1 is a view in plan of a product information tag according to one embodiment of the present invention.

Referring specifically to FIG. 1 of the accompanying drawings, a tag according to a first embodiment of the present invention is generally designated by the reference numeral 10. Tag 10 is made of plastic material which may be transparent and, in the preferred embodiment, is preferably made of polypropylene with a thickness on the order of 15 mils. Tag 10 includes a generally rectangular indicia-bearing portion 11 having opposed short sides 13, 15 and opposed long sides 17, 19. The front and back surfaces of indicia-bearing portion 11 of the tag both readily adhere to the adhesive provided on the reverse side of pressure-sensitive labels of the type which are generally provided with removable backing paper to protect the adhesive coating prior to deployment of the label. Such labels are used in conjunction with tag 10 to provide the indicia which appears on indicia-bearing portion 11. A tag support structure 20 is disposed at the distal end of a short neck or stem portion 21 which extends outwardly from edge 19 of the indicia-bearing portion 11. The support structure is generally rectangular and includes relatively long sides 23, 25 which are parallel to edge 19, and relatively short sides 27, 29 which are perpendicular to edge 19, Edges 23 and 25 are shorter than the parallel edges 17 and 19 of indicia-bearing portion 11. The cut-away portions between edges 19 and 25 and opposite sides of neck 21 serve as an alternative tag support arrangement as described below with reference to FIG. 11. An elongated slot 30 is defined in support structure 20 with its length dimension extending parallel to edges 23 and 25. The length of slot 30 is greater than the corresponding dimension of stem 21 and is totally enclosed within support structure 20.

Figure 2:
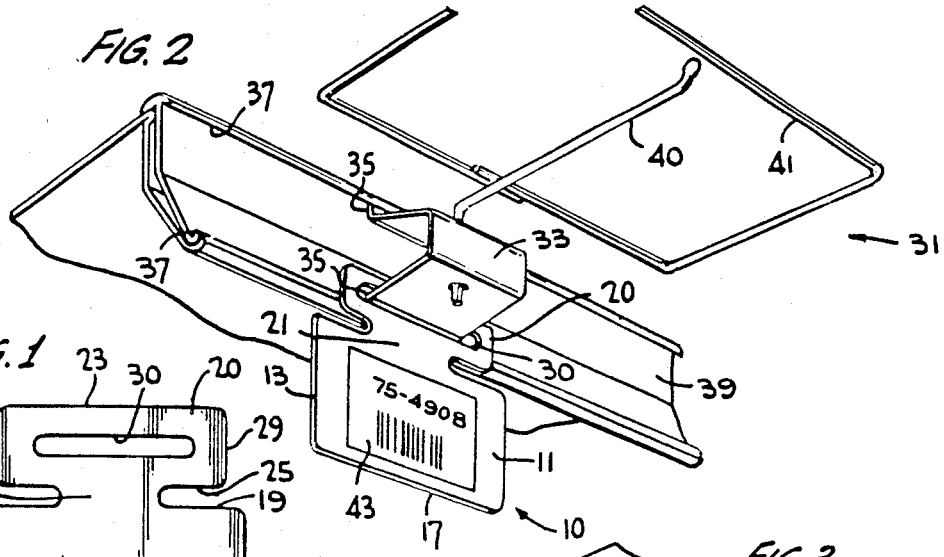
FIG. 2 is a view in perspective of the tag of FIG. 1 suspended from a J-hook which is attached to a price molding for a merchandise display.

Referring to FIG. 2, tag 10 is shown to be suspended from the support portion of a J-hook which is generally designated by the reference numeral 31. J-hook 31 includes a generally U-shaped bracket member 33 having outwardly projecting lips 35 formed at the distal ends of its legs. Bracket member 33 is resilient such that its legs may be squeezed toward one another to permit lips 35 to be engaged within respective horizontally-extending support channels 37 of a price molding 39. The price molding 39 is a commonly employed molding member secured to the forward edge of a product display shelf and to which product-identification cards, as well as support brackets for hooks, are secured. The J-hook 31 includes a support bar 40 which is secured to bracket 33 and projects forwardly of price molding 39. Support bar 40 is arranged to be inserted through apertures in blister pack display items which are thereby suspended from the support bar 40 in front of price molding 39. The J-hook 31 is also shown to include a protective frame 41 of generally rectangular configuration and provided so as to protect passers-by from injury by impacting against the distal end of bar 40.

Figure 3:
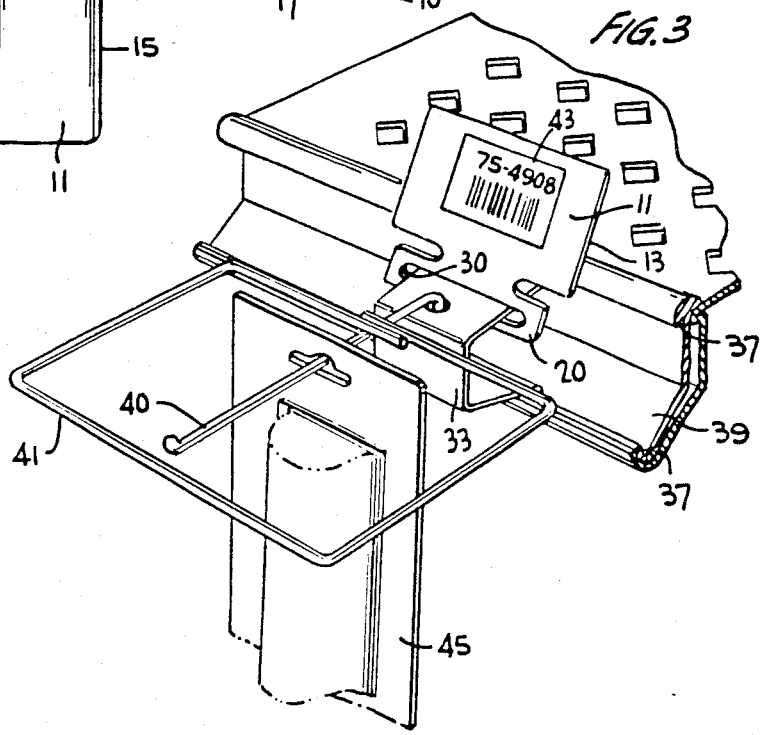
FIG. 3 is a view in perspective of the tag of FIG. 1 secured to a J-hook similar to that illustrated in FIG. 2 but wherein the tag is supported in a position inverted relative to that of FIG. 2.

Tag 10, in the deployment mode illustrated in FIG. 2, has the lower leg of bracket 33 extending through slot 30 with the indicia-bearing portion 11 suspended below the tag support structure 20. In addition, a gummed or adhesively backed product identification label 43 is secured to the outwardly facing side of indicia-bearing portion 11 of tag 10. When supported in this manner, the tag 10 resides behind the displayed merchandise which is suspended from bar or rod 40. Alternatively, as illustrated in FIG. 3, tag 10 may be supported with the upper leg of bracket 33 extending through slot 30 so that the indicia-bearing portion 11 of the tag resides above the tag support structure 20. With this mode of deployment, the indicia appearing on the label 43 are visible above the blister packs 45 suspended from rod 40. It will be readily appreciated, of course, that if support bracket 33 is replaced by a support member extending in a substantially vertical plane, the tag 10 can likewise be supported with slot 30 extending vertically rather than horizontally as illustrated in FIGS. 2 and 3. Under such circumstances, the tag 10 will extend to the side of the displayed products and will also be readily visible, if desired. It is important that the slot 30 have a length which is at least equal to the corresponding dimension of the leg of bracket 33 extending through the slot. It is also important, particularly when the tag 10 is supported in the manner shown in FIG. 3, that the tag have sufficient rigidity so as not to bend or curl when the indicia-bearing portion 11 is disposed above the support structure 20. The 15 mil thick polypropylene, noted above as useful in the preferred embodiment, has sufficient rigidity for this purpose. Of course, other types and thicknesses of plastic material have the same property.

The transparent nature of tag 10 prevents it from being an eye-sore and permits it to blend in with substantially any background. This is a feature which is important in attractive merchandise displays. Alternatively, the tag may be made of a suitable colored, non-transparent plastic material to match or contrast with the background in an eye-pleasing manner.

Figure 11:
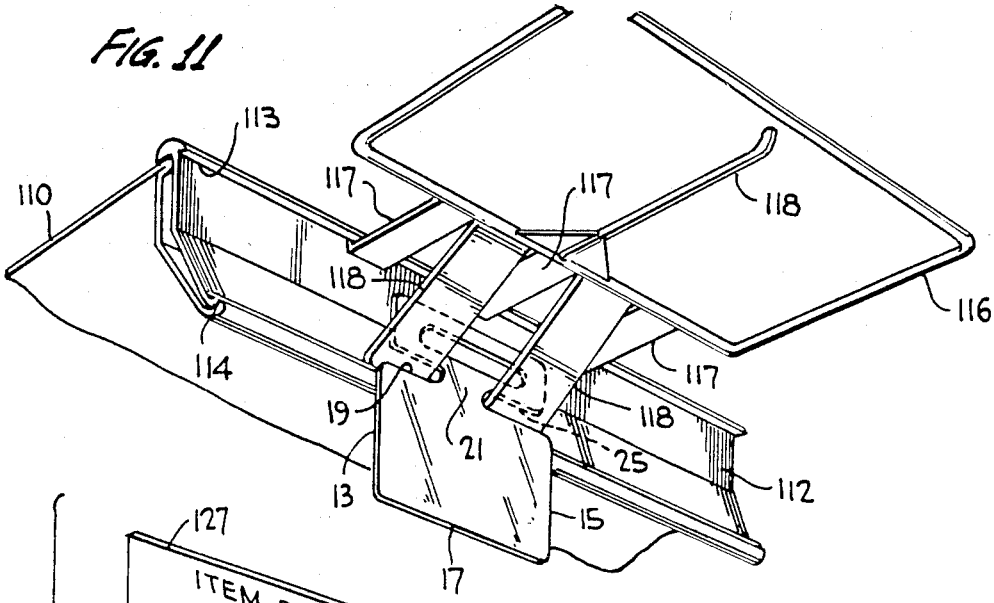
FIG. 11 is a view in perspective showing the tag of FIG. 1 supported from a J-hook in an alternative manner.

Although slot 30 is sized specifically to permit the tag 10 to be supported in the manner described, in some applications, the tag may be supported at the cut-away portions disposed between edges 19 and 25 on opposite sides of neck 21. Such an arrangement is illustrated in FIG. 11, to which specific reference is now made. A commonly employed horizontally-disposed merchandise shelf 110 is fitted with a price molding 112 along its forward edge. The price molding 112 is provided with horizontally-extending upper grooves 113 and lower grooves 114 formed by respective bent-over lips of the price molding structure. A merchandise support and display member includes a rectangular frame member 116 from one side of which a plurality of upper tongue-like members 117 and lower tongue-like members 118 extend rearwardly to resiliently engage grooves 113 and 114, respectively. This engagement supports the frame wholly for the price molding. A hanger 118 extends inwardly from the same side of the frame to a location just short of the opposite frame side. The space between hanger member 118 and the opposite frame side is used to permit insertion of apertured blister cards or the like over the hanger member 118 from which the blister cards are expended for merchandising display purposes. The two lower tongue-like members 118 are spaced from one another by the width, or slightly more than the width, of neck 21 and are sufficiently thin to fit within the two (2) cut-away portions between edges 19 and 25 on opposite sides of neck 21. Tag 10 is therefore capable of being supported from these cut-away portions on members 118, as illustrated.

Figure 4:
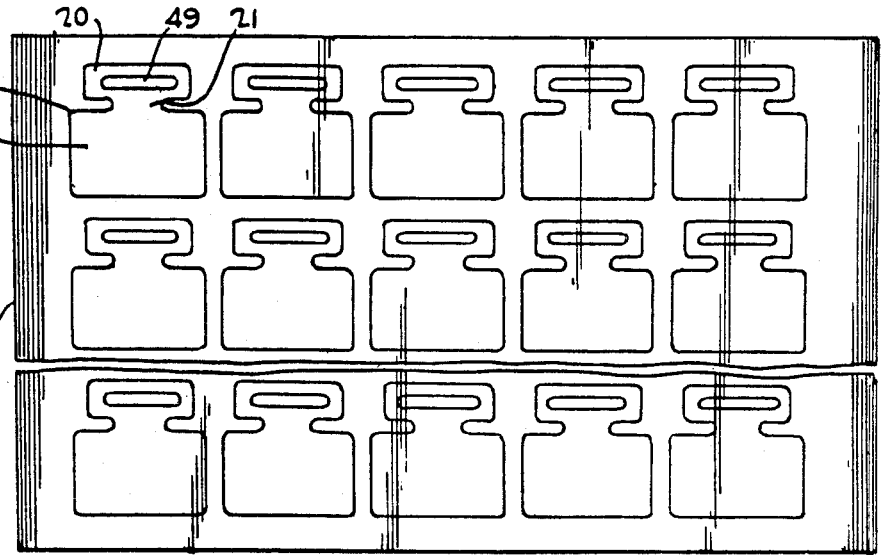
FIG. 4 is a view in plan of a sheet of plastic in which a plurality of tags of the type illustrated in FIG. 1 are die-cut.
Figure 5:
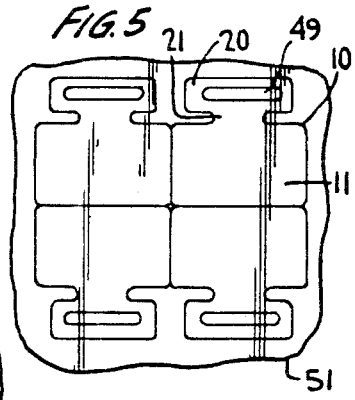
FIG. 5 is a cut-out portion of an alternative sheet of the type illustrated in FIG. 4 wherein space is conserved by die-cutting the tags in clusters.

Referring to FIG. 4, a sheet 47 of plastic material is shown die-cut to form a plurality of tags 10 of the type illustrated in FIG. 1. The die-cutting procedure is a well-known technique and need not be described herein. When a user wishes to remove a tag 10 from sheet 47, he or she need merely push that tag through the sheet so that it disconnects therefrom and then push the strip of material 49, which is disposed in slot 30, from the slot so as to open the slot and render the tag ready for use. The orientation of tags 10 on sheet 47 illustrated in FIG. 4, can be wasteful of plastic material. In order to conserve such material, the die-cuts can be made such that they are shared by adjacent edges of adjacent tags. For example, in referring to FIG. 5, sheet 51 is shown with tags formed in clusters of four (4) wherein each tag shares a die-cut along its bottom edge 17 and a side edge 13 or 15.

Figure 6:
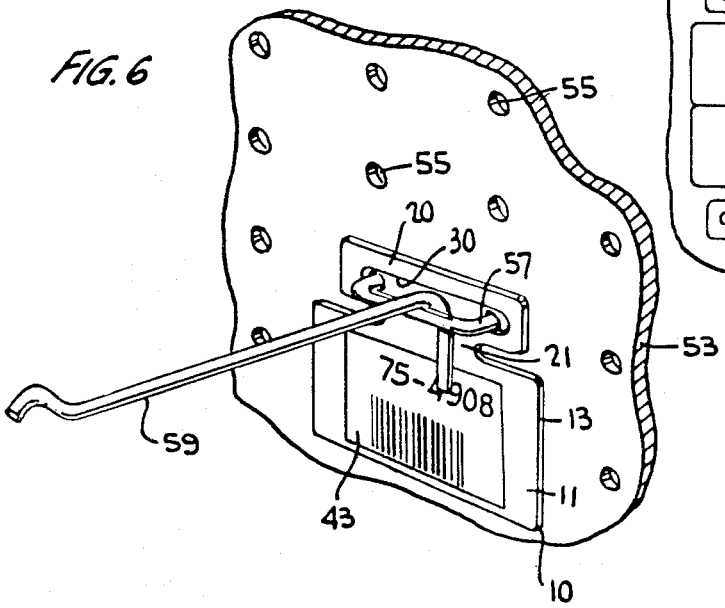
FIG. 6 is a view in perspective of the tag of FIG. 1 employed in conjunction with a peg hook and peg board.

The tag 10 of FIG. 1 is also useful in conjunction with peg hooks in the manner illustrated in FIG. 6. Specifically, a peg board 53 is provided with a plurality of equally spaced holes 55 in the manner well known in the merchandising display field. A conventional peg hook includes a support member 57 and a hook member 59. Support member 57 is a bar bent into a generally U-shaped configuration with its legs spaced to permit each to be inserted through a respective hole 55 in peg board 53. The extreme ends of the legs (not shown) of member 57 are abent downwardly so as to engage the back wall of peg board 53 when member 57 is inserted therein. Hook member 59 has a rear portion which is disposed in the space between support member 57 and peg board 53 so that the merchandise has a supporting hook which projects forwardly of the peg board. Tag 10 is placed against peg board 53 with the base of support member 57 projecting outwardly through slot 30. The tag is held against the peg board by hook member 59 so that the tag does not slip off the support member 57. The tag 10 is illustrated in FIG. 6 in a manner analogous to that of FIG. 2 wherein the indicia-bearing portion 11 is suspended below the tag support portion 20; however, it should be apparent that the tag can be inverted so that the indicia-bearing portion 11 resides above the tag support portion 20.

Figure 7:
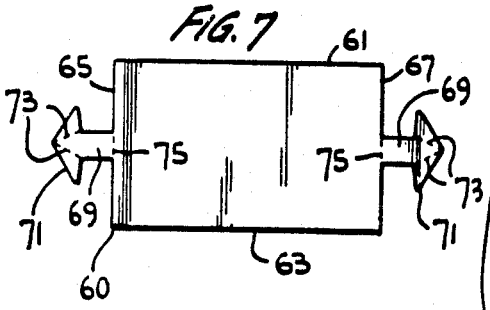
FIG. 7 is a view in plan of a tag in accordance with a second embodiment of the present invention.

A second tag embodiment in accordance with the present invention is illustrated in FIG. 7 and generally designated by the reference numeral 60. Tag 60 is made of plastic material and is preferably in the form of a rectangle having two (2) long sides 61, 63 and two (2) short sides 65, 67. A first support structure includes a stem 69 extending as an integral part of the tag from short side 65. The distal end of stem 69 terminates in a bi-winged or anchor-like member 71. The wings of member 71 extend beyond the width of stem 69. Perforations 73 are provided to permit the wings to be folded resilient inward. In addition, a perforation 75 is provided at the proximal end of stem 69 so that the stem may be folded, resiliently, out of the plane of the indicia-bearing portion of the tag 60.

An identical support structure, bearing like reference numerals, is provided to extend from the other short side 67 of tag 60. The two (2) stems 69 thus extend in opposite directions, terminate in anchor-like members 71 and are resiliently bendable out of the plane of the main body of tag 60.

Figure 8:
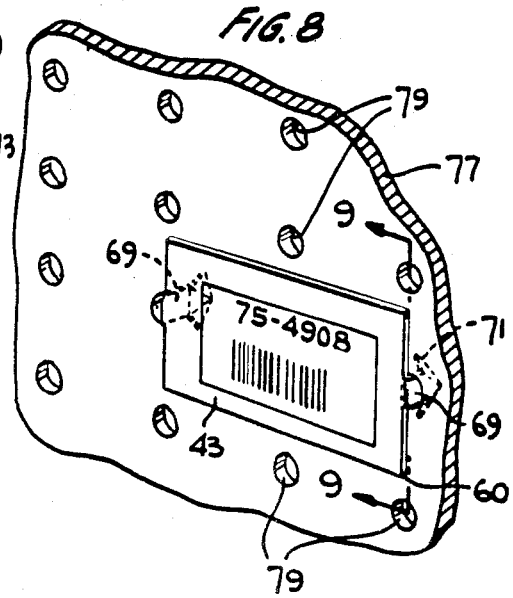
FIG. 8 is a view in perspective of the tag of FIG. 7 secured to a peg board.

Tag 60 is arranged to be secured to a peg board 77 in the manner illustrated in FIG. 8. Specifically, peg board 77 has a plurality of spaced holes 79 defined therethrough. Stems 69 have a width which is equal to or less than the diameter of holes 79 so that the stems can reside comfortably within the holes. Each stem may be inserted into a corresponding hole 79 by bending the anchor-like member 71 along fold lines 73 so that the anchor-like member may be forced through the hole. After being thusly inserted into the hole, the anchor-like member expands so as to prevent inadvertent withdrawal of the anchor-like member by virtue of the latter contacting the rear surface of the peg board 77.

The dimensions of the sides 61, 63, 65, 67 of the tag 60, and the length of stems 69 are chosen to permit insertion of the stems into peg board holes 79 having a prescribed space therebetween. The spaced holes need not be the most closely spaced holes on the peg board but instead, as illustrated in FIG. 8, can be any two (2) spaced holes. Thus, in the embodiment illustrated in FIG. 8, if the spacing between holes is considered uniform and equal to the value X, the opposed stems of tag 60 are designed to be inserted into holes having a spacing 2X. It should be noted that the stems need not be bent along the edges from which they project from the tag in the manner shown in FIG. 8; rather, the long sides 61, 63 of the tag may be shorter than the spacing between the insertion holes so that the stems extend along the front surface of the peg board before being bent into the holes.

The tags can be removed and installed in other holes by simply reaching behind the peg board, folding the anchors along the fold lines and withdrawing the stems 69 from the holes in which they are inserted. Likewise, display tag 43 may be covered with other display tags depending upon the changes in the displayed product.

Figure 10:
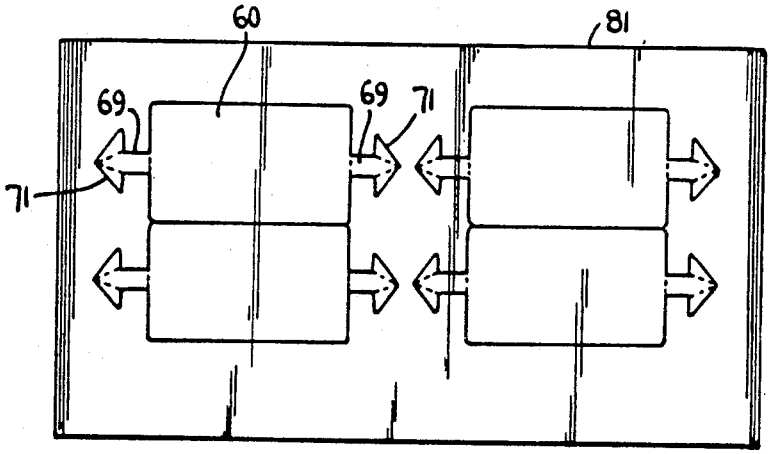
FIG. 10 is a view in plan of a sheet of plastic material in which a plurality of tags according to FIG. 7 are die-cut.

The tags 60 may be formed as die-cuts in a sheet 81 in the manner illustrated in FIG. 10. The die-cuts may be made so that adjacent tags 60 share a die-cut along their adjacent long edges. The tags 60 may be punched out or forced from sheet 81 when ready for use.

Figure 12:
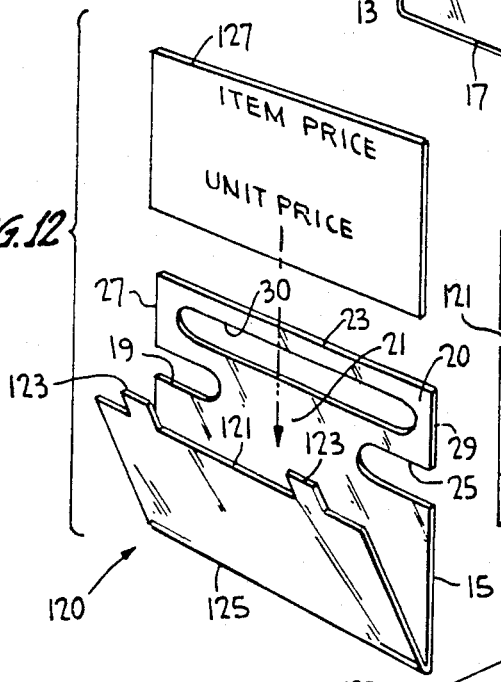
FIG. 12 is an exploded view in perspective of a modified version of the tag of FIG. 1.
Figure 13:
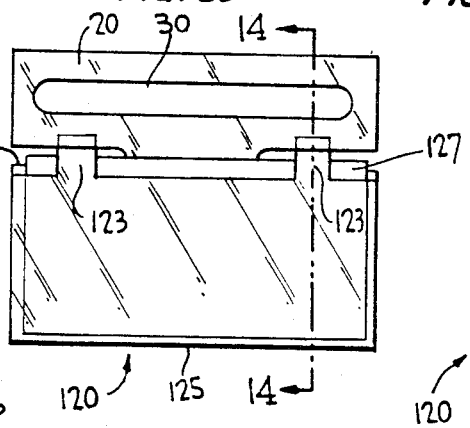
FIG. 13 is a view in plan of the tag embodiment of FIG. 12.
Figure 14:
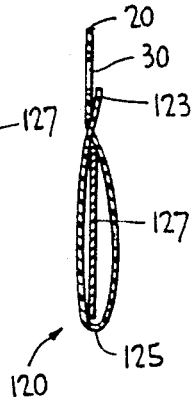
FIG. 14 is a view in section taken along lines 14—14 of FIG. 13.

Another tag embodiment 120 of the present invention is illustrated in FIGS. 12, 13, and 14 to which specific reference is now made. Tag 120 is similar to tag 10 of FIG. 1 and similar features of the two tags bear the same reference numerals in the drawings. The differences reside in the fact that tag 120 is longer in height than tag 10 so that the bottom of tag 120 can be folded upward onto itself about a horizontal fold line 125 to define a pocket into which a label 127 can be inserted. The bottom edge 121 of tag 120 is provided with two (2) projections 123 which are transversely spaced by a distance greater than the width of neck 21. Projections 123 are sufficiently long to permit them to be inserted into the cut-away portions on opposite sides of neck 21 and to extend beyond edge 25. In this manner, the projections 123 can be flexed to extend behind support structure 20 and serve as a selectively operable closure mechanism for the label-containing pocket formed by the folded tag 120. Tag 120 is readily supported at slot 30 in the same manner as tag 10. The replaceable label 127 eliminates the requirement for adhesively securing the label to the tags so that labels can be replaced rather than adhering successive labels over one another.

Figure 15:
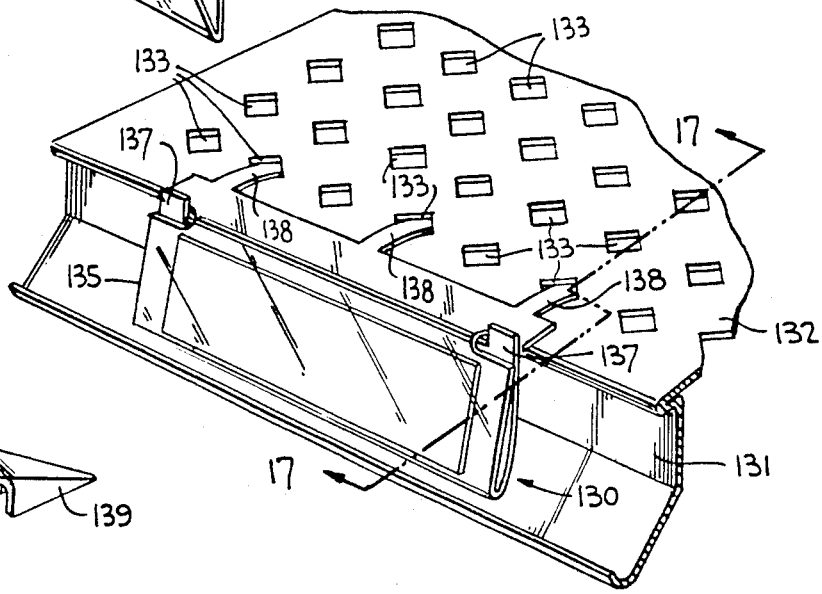
FIG. 15 is a view in plan of a modified version of the tag of FIG. 7 showing the tag secured at the edge of a display shelf.
Figure 16:
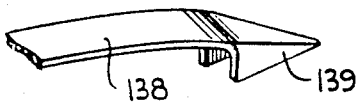
FIG. 16 is a partial view in perspective of a support portion of the tag of FIG. 15.

The tag embodiment illustrated in FIGS. 15, 16, and 17 is a modification of the tag 60 of FIG. 7 and incorporates the pocket feature of tag 120 of FIGS. 12, 13, and 14. Specifically, tag 130 is adapted to be suspended in front of the forward edge 131 of the display shelf 132. Tag 130 is particularly useful where the display shelf does not have a price molding; however, it can also be suspended in front of a price molding when desired. The display shelf 132 with which the tag 130 is used must have a plurality of through-holes 133 defined therein. Some of the holes 133 are disposed in close proximity to the forward edge 131 of the shelf.

Tag 130 is made of plastic material and includes a support portion 134 of generally rectangular configuration and integrally connected to an indicia-bearing portion 135 by means of a neck or stem 136. The lower part of the indicia-bearing portion 135 is folded up and behind the top part to define a pocket into which a price and/or product indentification label can be inserted. The upwardly folded distal end of the indicia-bearing portion 135 includes two (2) spaced projections 137 which fit into respective spaces on opposite sides of the stem 136 when the tag is bent transversely along the stem. With the tag thusly bent, the support portion 134 can be oriented horizontally along the forward lip of shelf 132 so that the indicia-bearing portion 135 is suspended in front of shelf edge 131. A plurality, for example three (3), projections 138 extend perpendicularly away from the support portion 134 toward holes 133 and are sufficiently long to be inserted in respective holes. Each projection 138 terminates in the bi-winged or anchor-like member 139 which is resiliently folded to permit members 139 to be inserted into holes 133. The projections 138 are sufficiently long to permit the anchor-like members to extend beyond holes 133 in which they are inserted. When the members 139 are unfolded, they spread to a size larger than holes 133 thusly securing tag 130 in a anchored position relative to shelf 132. A label can be readily inserted into the tag pocket and replaced by opening the pocket. Opening of the pocket is achieved by pulling the rear half of the indicia-bearing portion 135 downward to remove the projections 137 from engagement between the forward half of the portion 135 and the forward lip of shelf 132.

Figure 9:
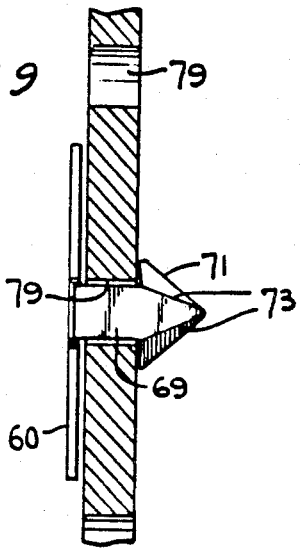
FIG. 9 is a view in section taken along lines 9—9 of FIG. 8.

The tag embodiment illustrated in FIGS. 18–20 is a modified version of the tag illustrated in FIGS. 7, 8, and 9, wherein like elements bear the same reference numerals as elements appearing in FIGS. 18, 19, and 20. The only difference in tag 140 of FIGS. 18–20 resides in the fact that the bottom edge of the tag is folded rearwardly to provide a bottom shelf 141 for supporting a price and/or product identification label 142 on edge behind the shelf. The shelf 141 thus permits the tag 140 to be used without adhering the label 142 directly to the tag. The label 142 can thereby be readily replaced rather than adhering successive labels onto one another.

The tag embodiment illustrated in FIG. 21 is adapted to be used in conjunction with a wire display basket 145. Specifically, a tag member 60 which is substantially identical to the tag member illustrated in FIGS. 7, 8, and 9 is provided with a separable backing member 146 which, in the embodiment illustrated in FIG. 21, has a generally rectangular configuration. Backing member 146 must extend to a length which is greater than the spacing between sides 65 and 67 on tag 60. A pair of slots 147 are defined through backing member 146 and extend in length in a direction parallel to sides 65 and 67 of tag member 60. Slots 147 are spaced to permit projections 69 to extend therethrough and are of sufficient length to permit the members 71, when folded, to be inserted through the slot. When members 71 are unfolded, they serve as anchors to prevent withdrawal of projections 69 from the slots 147. Tag member 60 may thusly be secured to backing member 146 with the projections 69 extending through slots 147. When, as illustrated in FIG. 21, the backing member is placed along the inside surface of a wire basket 145, and the tag member 60 is placed in juxtaposition with the backing member 146 but along the outside surface of basket 145, the two (2) members may be secured to one another and to the basket with the tag member 60 disposed on the outside of the basket. A price and/or product identification label 148 may readily be affixed to the exposed surface of tag 60 by adhesive or the like.

The support ledge feature of the embodiment of FIGS. 18, 19, and 20 may be incorporated into the tag support arrangement of FIG. 21 by providing a ledge 141 at the bottom edge of the tag. Such an arrangement is illustrated in FIGS. 22 and 23 wherein a label is inserted between the tag 140 and the basket 145 so as to rest on its bottom edge along ledge 141. As noted above, concerning the embodiment of FIGS. 18–20, the ledge 141 permits replacement of labels without adhering one label atop the other.

Referring now to FIG. 24 of the accompanying drawings, a modified tag 160 of the present invention is generally rectangular and has a mounting edge 161 chosen as one of its sides, preferably a longer side. Two mounting holes 162, 163 are defined through tag 160 in alignment parallel to and slightly spaced from mounting edge 161. The spacing between mounting holes 162, 163 is substantially equal to the spacing between holes (usually adjacent holes) in a peg board of the type employed for merchandise display. Mounting holes 162, 163 are not entirely enclosed in that respective access channels 164, 165 extend therefrom all the way to mounting edge 161. Access channels 164 and 165 extend from small openings in the peripheries of respective mounting holes 162 and 163, which small openings are spaced by less than the distance between holes in the peg board with which tag 160 is to be used. In addition, the small mounting hole openings for channels 164 and 165 are preferable smaller than the diameter of the legs of the peg board hook mounting member (see member 57 of FIG. 6; member 173 of FIG. 25). From these small openings the channels 164, 165 each have divergent configurations toward mounting edge 161 of the tag. Specifically, one side of access channel 164 is formed as a side of a generally regular trapezoidal-shaped flap 166 defined with its short base extending along mounting edge 161 between the two mounting holes 162 and 163. Likewise, one side of access channel 165 is formed by the other side of flap 166 which converges generally toward the other side of the flap in a direction toward the mounting edge 161. The other side 167 of access channel 164 diverges from the flap side of that channel in a direction toward mounting edge 161. Likewise, the other side 168 diverges from the flap side of access channel 165 in a direction toward mounting edge 161. Channel edges 167 and 168 have inboard terminations at the peripheries of mounting holes 162 and 163, respectively, the respective intersections with the mounting hole peripheries forming acute angular tips 169, 170 which point generally at flap 166. The two tips 169, 170 also point generally toward one another (i.e. in a generally inboard direction of the tag) and are spaced by less than the distance between the holes in the peg board with which tag 160 is used. Such a peg board 171 is illustrated in FIG. 25 and has regularly spaced holes 172 defined therein. A hook support member 173 and hook 174, substantially identical to member 57 and hook 59 of FIG. 6, cooperate to suspend merchandise items from the hook forwardly of the peg board. Tag 160 can be deployed so as to be supported from hook support member 173 by flexing points 169 and 170 out of the plane of the tag while sliding flap 166 between the legs of member 173 so that these legs pass through access channels 164, 165 into respective mounting holes 162, 163. Upon release of the flexed pointed regions 169, 170, the natural resilience of the tag structure restores the pointed regions to the plane of the tag whereby they overlie the legs of hook support member 173. The tag is thusly supported in substantially any orientation whereby mounting edge 161 is oriented vertically, at some angle between horizontal and vertical, or as the lowermost edge of supported tag. The tag 160 can be removed from hook support member 173 by merely flexing pointed flaps 169, 170 once again and sliding the tag so that the legs of member 173 pass out of holes 162, 163 and through the access channels 164, 165.

The tag mounting structure illustrated in FIGS. 24 and 25 permits the tag to be secured to the peg hook arrangement without removing hook-supported merchandise, without disassembling the hook 174 from hook support member 173, and without removing hook support member 173 from board 171.

Figure 26:
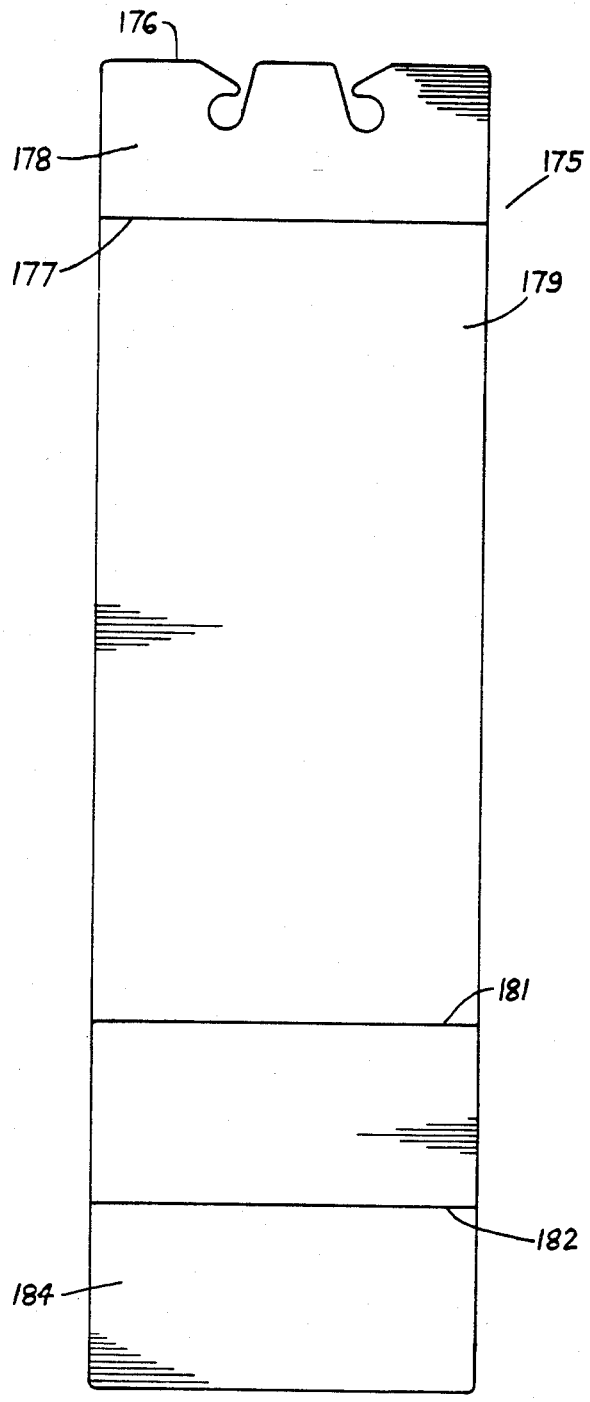
FIG. 26 is a view in plan of a further modified product information tag which permits the product information to be displayed forwardly of the suspended merchandise items.

The embodiment of FIGS. 26 and 27 is intended for applications wherein product identification information is intended to be displayed forwardly of displayed merchandise. The tag 175 is shown with a mounting structure identical to the mounting structure for tag 160 of FIG. 24, whereby tag 175 can be snapped on and off a peg board hook support member. However, it will be appreciated that the forward display feature of tag 175 does not rely on a particular mounting structure and could therefore also be employed with the mounting slot of the embodiment of FIG. 1, the mounting holes of the embodiment of FIG. 28 described hereinbelow, or substantially any other mounting arrangement. The mounting structure for tag 175, whatever form it may take, is disposed adjacent a relatively short edge 176 of the elongated, generally rectangular tag. A fold line 177 extending generally parallel to edge 176 defines a support section 178 between line 177 and edge 176. In use, tag 175 is folded to form a right angle at bend line 177 so that the adjacent section 179 of the tag extends forwardly of section 178 and peg board 180 when mounting section 178 is mounted against the front surface of the peg board. One or more additional fold lines 181, 182 are also formed in tag 175, also parallel to edge 176 but proximate the opposite end of the tag. Depending upon the length of the hook member 183 with which tag 175 is to be employed, the tag is folded at right angles along one of fold lines so that the distal end of the tag extends downwardly in front of hook 183 to define a display section 184. In this position of tag 175, a merchandise item suspended from hook 183 can easily be slid off the hook without removal of or interference by the tag.

It will be appreciated that this forward extension feature can also be employed with other types of merchandise support arrangements, such as the J-hook arrangement illustrated in FIG. 3, depending upon the take support structure employed.

The tag embodiment illustrated in FIG. 28 is configured for use with peg board mounting in situations where the snap-on, snap-off feature is not needed. Specifically, tag 190 is provided with two mounting holes 191, 192 spaced to match the spacing between the legs of hook support member 173 of FIG. 25. Tag 190 is deployed by removing the hook support member 173 from the peg board 171, placing tag 190 with mounting 191, 192 aligned with respective holes in the peg board, and then inserting the legs of member 173 through holes 191, 192 and the aligned peg board holes.

The tag embodiment 195 illustrated in FIG. 29 is very similar to that illustrated in FIG. 24. The main difference resides in the fact that the access channels 164 and 165 for respective mounting holes 162 and 163 include slits 196 and 197 defined in the plastic material rather than the defined spaces between flap 166 and the points 169 and 170 of FIG. 24. Instead of terminating in points, the sides of slits 196 and 197 which face flap 166 are configured to match the contour of the facing flap side and to normally abut that side, edge-to-edge, when the unit is unflexed. This narrowed slit portion of the access channel, with the necessarily wider section of the channel (as opposed to pointed sections 169, 170) provides a more secure locking feature than is the case for the tag of FIG. 24. The more secure locking may be required for certain types of peg board hook structures presently being used and which differ somewhat from the hook illustrated in FIG. 25.

While I have described and illustrated various specific embodiments of my invention, it will be clear that variations of the details of construction which are specifically illustrated and claimed may be resorted to without departing from the true spirit and scope of the invention as defined in the appended claims.

What is claimed is:

1. In combination:

a product identification tag comprising a substantially planar sheet of resiliently flexible plastic material having a mounting edge, said sheet including first and second transversely spaced mounting holes defined therein by respective first and second circumferential edges, said mounting holes each being slightly longitudinally spaced from said mounting edge, wherein said first and second mounting holes have respective first and second centers which are mutually spaced by a predetermined distance, said sheet further having first and second access cuts defined therein and extending from said mounting edge to said first and second circumferential edges, respectively, said access cuts each having respective mutually convergent first sides, wherein said first sides of said first and second access cuts, respectively, face away from one another and are transversely spaced along their entire lengths by less than said predetermined distance, wherein said first and second access cuts intersect said first and second circumferential edges, respectively, at respective first and second access breaks in said first and second circumferential edges, respectively, and wherein said first and second access breaks are everywhere disposed transversely closer to one another than said predetermined distance; and a support member having first and second legs which are spaced by said predetermined distance and having cross-sectional configurations which fit within said first and second mounting holes, respectively.

2. The combination according to claim 1 wherein each access cut further includes a second side which converges with said first side generally toward a corresponding mounting hole from said mounting edge.

3. The combination according to claim 2 wherein said sheet further includes a generally rectangular trapezoidal flap having a short base disposed along said mounting edge and two opposite sides corresponding to said first sides which mutually converge in a direction toward said mounting edge.

4. The combination according to claim 3 wherein said first and second access cuts extend from the access breaks in the circumferential edges of said first and second mounting holes, respectively, said access breaks being narrower than said legs of said support member to preclude passage of said legs into and out of said mounting holes unless said sheet is flexed.

5. The combination according to claim 1 wherein said each access cut includes a slit in which said first and second sides abut one another.

6. The combination according to claim 1 wherein said sheet includes an integral extension portion extending from and substantially perpendicular to said planar sheet, and an integral display section extending from and substantially perpendicular to said extension portion.

* * * * *